US011272782B2

(12) United States Patent
DeVerse et al.

(10) Patent No.: US 11,272,782 B2
(45) Date of Patent: Mar. 15, 2022

(54) DEVICES AND METHODS FOR MATERIAL TRANSPORT BETWEEN SUBSTRATES

(71) Applicants: Paige Chryseis DeVerse, Kailua Kona, HI (US); Richard Andrew DeVerse, Kailua Kona, HI (US)

(72) Inventors: Paige Chryseis DeVerse, Kailua Kona, HI (US); Richard Andrew DeVerse, Kailua Kona, HI (US)

( * ) Notice: Subject to any disclaimer, the term of this patent is extended or adjusted under 35 U.S.C. 154(b) by 71 days.

(21) Appl. No.: 16/673,105

(22) Filed: Nov. 4, 2019

(65) Prior Publication Data

US 2020/0060419 A1 Feb. 27, 2020

Related U.S. Application Data

(62) Division of application No. 15/682,435, filed on Aug. 21, 2017, now Pat. No. 10,463,144.

(60) Provisional application No. 62/494,791, filed on Aug. 22, 2016.

(51) Int. Cl.

| | |
|---|---|
| ***A46B 17/06*** | (2006.01) |
| ***B08B 11/02*** | (2006.01) |
| ***B08B 3/04*** | (2006.01) |

(52) U.S. Cl.
CPC ..... *A46B 17/06* (2013.01); *B08B 3/04* (2013.01); *B08B 11/02* (2013.01); *A46B 2200/1046* (2013.01)

(58) Field of Classification Search
CPC ..... A46B 17/06
See application file for complete search history.

(56) References Cited

U.S. PATENT DOCUMENTS

2013/0333726 A1 12/2013 Goshi et al.

*Primary Examiner* — Jason Y Ko
(74) *Attorney, Agent, or Firm* — Knobbe, Martens, Olson & Bear, LLP

(57) ABSTRACT

Systems, methods, and devices for efficient and user-friendly transport of materials from a first substrate to a second substrate are described. Systems can include a first substrate vessel configured to hold a first substrate to be cleaned or extracted, a transport media delivery system in fluid communication with the first substrate vessel, and a catchment system. The transport media delivery system delivers a fluid transport medium, which may include a fluid in a supercritical phase, to the first substrate vessel. The fluid transport medium removes particles from the first substrate and carries the particles to the catchment system, where the particles can be exhausted to the atmosphere or deposited onto a second substrate such as a filter or disposal tray.

5 Claims, 12 Drawing Sheets

DEVICES AND METHODS FOR MATERIAL TRANSPORT BETWEEN SUBSTRATES

CROSS-REFERENCE TO RELATED APPLICATIONS

This application is a divisional of U.S. application Ser. No. 15/682,435, filed on Aug. 21, 2017, entitled "DEVICES AND METHODS FOR MATERIAL TRANSPORT BETWEEN SUBSTRATES," which claims the benefit of priority under 35 U.S.C. § 119(e) of U.S. Provisional Application No. 62/494,791, filed on Aug. 22, 2016. Each of the applications referenced in this paragraph is incorporated herein by reference in its entirety and for all purposes.

FIELD

The present disclosure generally relates to devices and methods for transferring material between substrates, and more specifically to the control of material transport using composition and phase modulated transport media.

BACKGROUND

Handheld tools may undergo harsh use. For example, tools used to grind or scour away materials may become clogged with debris, and may frequently need to be discarded and replaced. Similarly, brushes and applicators used to apply materials to surfaces may similarly become clogged with materials and cease to function optimally. Removal of materials such as contaminants, dirt, oils, extracts, or the like from a substrate may be desired for purposes such as cleaning, production of plant extracts, or other implementations. Water-based methods may damage items such as makeup brushes, especially for items including specialized natural or synthetic materials that require special care. Water-based methods may further be ineffective for removing or extracting hydrophobic compounds such as oils or plant extracts. Moreover, cleaning of cosmetic brushes or other items with water may require extensive drying times during which mold and bacteria can grown on or within the substrate. Hydrocarbon solvents can be an alternative to water-based methods, but may be hazardous to users and the environment.

SUMMARY

The systems, methods, and devices described herein have a number of innovative aspects, no single one of which is indispensable or solely responsible for their desirable attributes. Without limiting the scope of the claims, the summary below describes some of the advantageous features.

In one embodiment, a cleaning apparatus is described. The cleaning apparatus includes a cleaning vessel configured to receive a plurality of utensils, the cleaning vessel including a housing at least partially enclosing an interior space, a utensil support structure at least partially within the interior space and configured to support each of the plurality of utensils in a spaced configuration, and a plurality of nozzles, each nozzle of the plurality of nozzles configured to direct a fluid stream toward at least one utensil of the plurality of utensils. The cleaning apparatus further includes a transport media delivery system in fluid communication with the cleaning vessel, the transport media delivery system comprising an input structure sized and shaped to sealingly receive a cartridge containing a transport medium, a pressure vessel in fluid communication with the input structure and configured to receive and contain at least a portion of the transport medium from the input structure, a heating element configured to modulate the transport medium within the pressure vessel to a supercritical phase, and a fluid conduit configured to direct the transport medium from the pressure vessel to the plurality of nozzles of the cleaning vessel, such that each of the plurality of nozzles emits a stream of the supercritical transport medium toward the plurality of utensils. The stream of the supercritical transport medium causes contaminant particles to be dislodged from a surface of the utensils. The cleaning apparatus further includes an effluent removal system comprising an outlet of the cleaning vessel configured to receive at least a portion of the transport medium and the dislodged contaminant particles, and a receiving substrate comprising at least one of a filter and a disposal tray, the receiving substrate configured to receive the dislodged contaminant particles.

In some embodiments, transport medium comprises carbon dioxide and the heating element is configured to heat the transport medium to a temperature greater than 20° C.

In some embodiments, the cleaning vessel further includes one or more ultraviolet (UV) light sources configured to irradiate the plurality of utensils with UV radiation.

In some embodiments, the cleaning apparatus further includes one or more valves configured to control the flow of the transport medium from the pressure vessel to the cleaning vessel and a microcontroller in communication with the one or more valves and the heating element. The microcontroller includes processing circuitry configured to open and close the one or more valves and activate the heating element, and a memory storing computer-executable instructions that, when executed by the processing circuitry, cause the processing circuitry to open and close the one or more valves and activate the heating element according to a predetermined cleaning cycle.

In some embodiments, the utensil support structure includes a brush support structure configured to hold a plurality of brushes or smoking utensils in a spaced configuration.

In another embodiment, a material transport device is described. The material transport device includes a first substrate vessel at least partially surrounding an interior configured to receive a first substrate, a transport media delivery system in fluid communication with the first substrate vessel, and a catchment system. The transport media delivery system is configured to receive a transport medium, modify at least one of a temperature and a pressure of the transport medium to induce a supercritical phase of the transport medium, and cause at least a portion of the transport medium to travel to the first substrate vessel such that the portion of the transport medium contacts the first substrate and removes one or more particles from a surface of the first substrate. The catchment system is configured to receive the particles removed from the surface of the first substrate.

In some embodiments, the transport media delivery system is configured to cause a stream of the supercritical transport medium to travel toward and at least partially surround the first substrate.

In some embodiments, the material transport device is operable while the interior of the first substrate vessel is not sealed.

In some embodiments, the first substrate vessel includes a utensil support structure at least partially within the interior, the utensil support structure configured to support one or more utensils to be cleaned.

In some embodiments, the first substrate vessel comprises an organic matter container at least partially within the interior, the organic matter container configured to hold a quantity of organic matter for the extraction of a component of the organic matter.

In some embodiments, the transport medium includes carbon dioxide.

In some embodiments, the transport medium includes carbon dioxide and at least one of a solvent, a fragrance, or a flavor.

In some embodiments, the catchment system is configured to generate a negative pressure at an outlet of the first substrate vessel to draw the removed particles out of the first substrate vessel.

In some embodiments, the catchment system includes a metal screen filter configured to receive at least some of the removed particles by deposition and a heating element configured to pyrolyze the removed particles deposited on the metal screen filter.

In another embodiment, a portable material transport device is described. The portable material transport device includes a cartridge container configured to receive a pressurized fluid cartridge containing a transport medium, a chamber removably coupled to the cartridge container and configured to retain a first substrate therein, an exhaust structure coupled to the chamber and configured to allow gas to travel from the chamber to the environment, and a valve regulator system between the cartridge container and the chamber, the valve regulator system configured to selectively cause the transport medium to flow out of the cartridge and enter the chamber as one or more jets of fluid directed to be incident upon the first substrate. The one or more jets of fluid transport medium collect particles from the first substrate and carry the particles to the exhaust structure, and at least some of the particles are deposited on a second substrate coupled to the exhaust structure.

In some embodiments, the portable material transport device further includes a battery-powered heating element in proximity to the cartridge container, the heating element configured to heat the contents of the cartridge.

In some embodiments, the chamber comprises a container configured to hold a quantity of plant matter, wherein the valve regulator system is configured to direct a jet of the transport medium at the container, and wherein the second substrate includes a storage vessel.

In some embodiments, the transport medium is at least partially hydrophobic and selected for extraction of one or more chemicals from cannabis.

In some embodiments, the portable material transport device is substantially cylindrical, and the portable material transport device has a maximum diameter not greater than 4 inches and a length not greater than 18 inches.

In some embodiments, the second substrate comprises a filter disposed at least partially within the exhaust structure.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment, unless stated otherwise.

DETAILED DESCRIPTION

Figure 1:
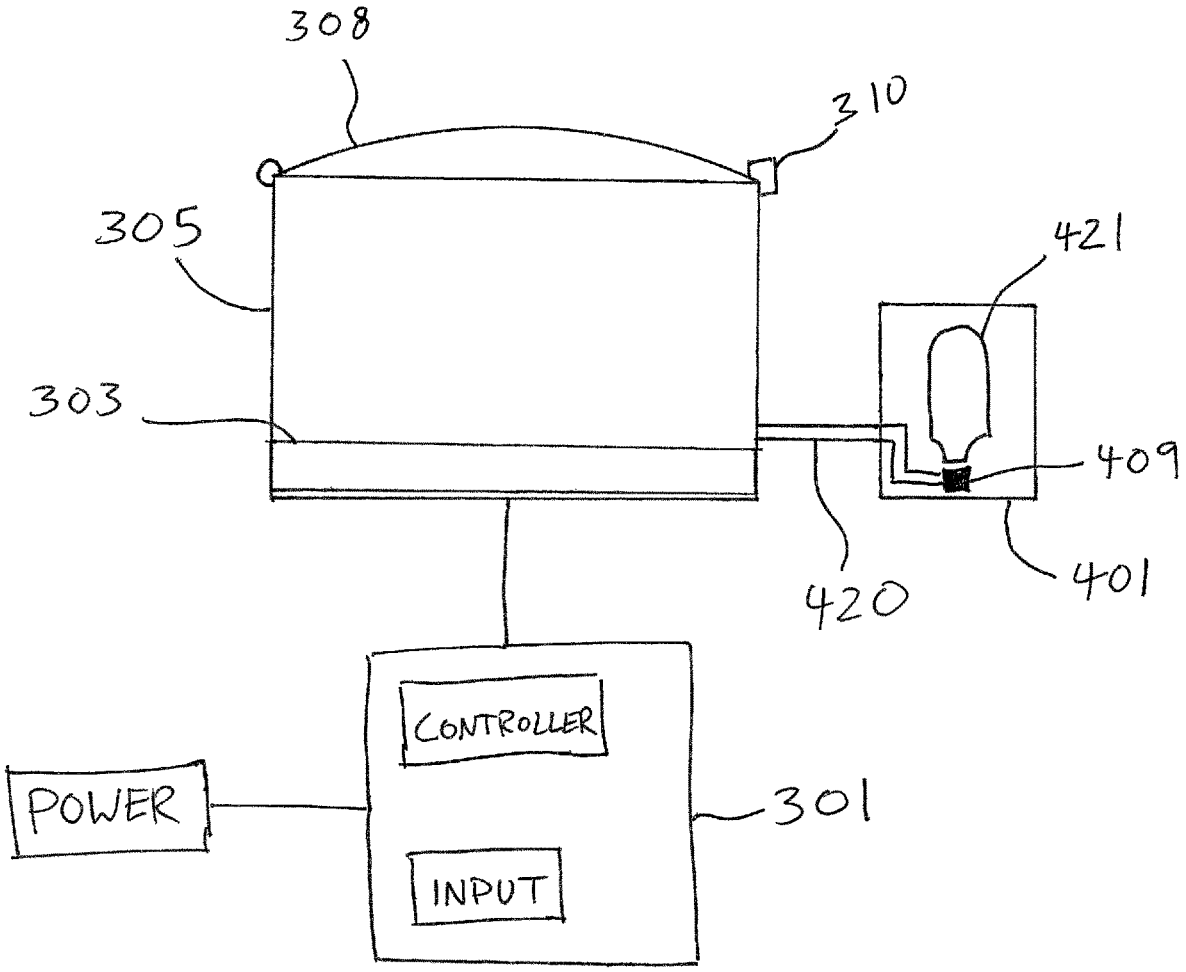
FIG. 1 is a schematic illustration of an example material transport device in accordance with an example embodiment.

Although the present disclosure is described with reference to specific examples, it will be appreciated by those skilled in the art that the present disclosure may be embodied in many other forms. The embodiments described herein are merely illustrative and do not limit the scope of the present disclosure.

In the description which follows, like parts may be marked throughout the specification and drawings with the same reference numerals. The drawing figures are not necessarily to scale and certain features may be shown exaggerated in scale or in somewhat generalized or schematic form in the interest of clarity and conciseness.

Generally described, the present disclosure provides systems, methods, and devices for transporting mass from a first substrate and/or between a first substrate and a second substrate by way of carefully controlled composition and phases of transport media. In various embodiments, transporting mass from a first substrate can include the cleaning of items such as textiles, garments, natural and synthetic fibers. In some embodiments, transporting mass from a first substrate can include the cleaning of utensils such as makeup brushes, other cosmetic applicators or utensils, smoking utensils (e.g., pipes, water pipes, hookahs, etc.), surgical utensils, electronic components such as circuit boards, or the like, by removing contaminants such as tars, greases, oils, or other materials from the surface of the utensils. A first substrate can be exposed to transport media such as supercritical $CO_2$ or other gases, such as in a sealed and pressurized environment, or by exposure to a directed stream of transport media, such that materials can be removed from the first substrate, even if the materials are physically bound by small cracks or other features of the substrate (e.g., brush bundles caked with cosmetic foundation materials). In some embodiments, transporting mass from a first substrate can include extracting components such as essential oils, tobacco extractions, cannabis extractions, or the like. Moreover, some embodiments of the present disclosure may simultaneously treat the first substrate and/or the transported mass, such as by sterilizing, conditioning, softening, flavoring, adding fragrance, or the like.

In some embodiments related to cleaning of a first substrate, the transported material, e.g., contaminants, are waste products and can be exhausted into the atmosphere and/or can be deposited into a receptacle. For example, contaminants can be deposited into a plastic or metallic pan, for convenient disposal. In another example, contaminants may be deposited into a filter, such as a paper or cloth filter, while some or all of the transport medium passes through the filter and is exhausted into the atmosphere. The systems and methods described herein can provide a thorough cleaning or extraction process, removing materials located in relatively inaccessible cavities of a substrate and depositing them in an easily disposable or storable container, while leaving the substrate dry and free of transport media.

In some embodiments related to extraction of substances such as essential oils, tobacco extractions, cannabis extractions, or the like, the extracted substances are of a usable form, and may be deposited into a storage container, such as a jar a vial, or the like.

As will be described in greater detail below, embodiments of the present disclosure may utilize transport media including supercritical fluids. Generally, a supercritical fluid may be described as a substance at a temperature and pressure above its critical point, such that distinct liquid and gas phases do not exist, and the substance incorporates properties of both gas and liquid states of the substance. For example, the substance may be effusive and simultaneously able to dissolve particles. Generating and handling supercritical fluids, such as supercritical carbon dioxide ($CO_2$), may be difficult and/or hazardous for an unskilled user. Thus, the systems and methods described herein can provide for simplified operation by an unskilled user. For example, a material transport device may be configured to use transport media provided in sealed single-use or multi-use canisters (e.g., canisters of pressurized $CO_2$, puncturable foil-sealed containers, etc.) that are relatively easily handled without specialized training.

In various embodiments, material transport devices described herein may be compact, lightweight, and portable, and may be configured to require relatively little to no power for operation. Accordingly, in some embodiments, the devices may be transportable in a backpack or handbag. Moreover, the devices may be operable in locations where an AC power supply is not available. Alternatively, the material transport devices may be incorporated in larger embodiments, for example, in larger standalone devices for installation in retail or kiosk environments, or in a large high-throughput tractor trailer-mounted unit for transport. In some embodiments, the material transport devices may provide for environmentally friendly disposal of transported materials, such as in a solid form that can be easily deposited in a landfill, rather than washed into groundwater or other water system. In addition, the material transport devices may be used to transport media from a substrate without introducing any hydrocarbon solvents to a user or the environment.

FIG. 1 is a schematic illustration of an example material transport device in accordance with an example embodiment. The material transport device includes a pressure vessel 305, a transport media housing 401, and computer components 301 configured to provide power to the material transport device and control material transport processes therein.

The pressure vessel 305 includes a lid 308. The lid 308 can be sealable to contain material transport media and any transmitting and receiving substrates within the pressure vessel 305. In some embodiments, the lid 308 is securable in a closed position by a latch 310. In some embodiments, the lid 308 may be securable by a screw-type closure or other securing structure. A heating element 303 is located in close proximity to at least a portion of the pressure vessel 305 to provide temperature control of the transport media. For example, the heating element 303 may be a coil or resistive heating band extending around the exterior of a portion of the pressure vessel 305.

The transport media housing 401 is configured to hold a supply of one or more transport media outside the pressure vessel. In the embodiment depicted in FIG. 1, the transport media housing 401 includes an engagement nozzle 409 configured to receive a cartridge 421 containing a transport medium such as $CO_2$ or another gas or combination of gases. In one example, the cartridge 421 can include a combination $CO_2$ and a small fraction of an alcohol co-solvent with disinfectant, antiseptic, fragrance and/or flavor constituents. The transport medium can be contained within the cartridge at a pressure such as 1000 psi, 800 psi, 600 psi, or less. Transport media received at the engagement nozzle 409 can be delivered to the pressure vessel 305 by a delivery tube 420. In some embodiments, the transport medium can further be conditioned before entering the pressure vessel 305. In some embodiments, the transport medium can be heated by the heating element 303 or by another heating element (e.g., within the transport media housing and/or along the delivery tube 420).

The computer components 301 may be external to the pressure vessel 305 and transport media housing 401, and/or may be combined with or attached to the pressure vessel 305 or transport media housing 401. The computer components 301 are connectable to a power source. A controller, such as a microcontroller, integrated circuit, or the like, along with a user input, can be used to control the process of modulating phases through heat and movement of the material transport media. Specialized cycles can be selected through the user interface to optimize the cycles of phase changes for specific materials and substrates. In various embodiments, the user input may allow a user to customize aspects of a material transport cycle, such as temperature, phase, duration, etc. In some embodiments, predetermined cycles may be provided automatically such that a user can initiate a material transport cycle by pressing a single button or selecting from several options provided. Automated material transport cycles may be customized to a particular substrate type, for example, a particular plant for extraction, or a particular brush type or set of brush types with natural or synthetic bristles.

Figure 2:
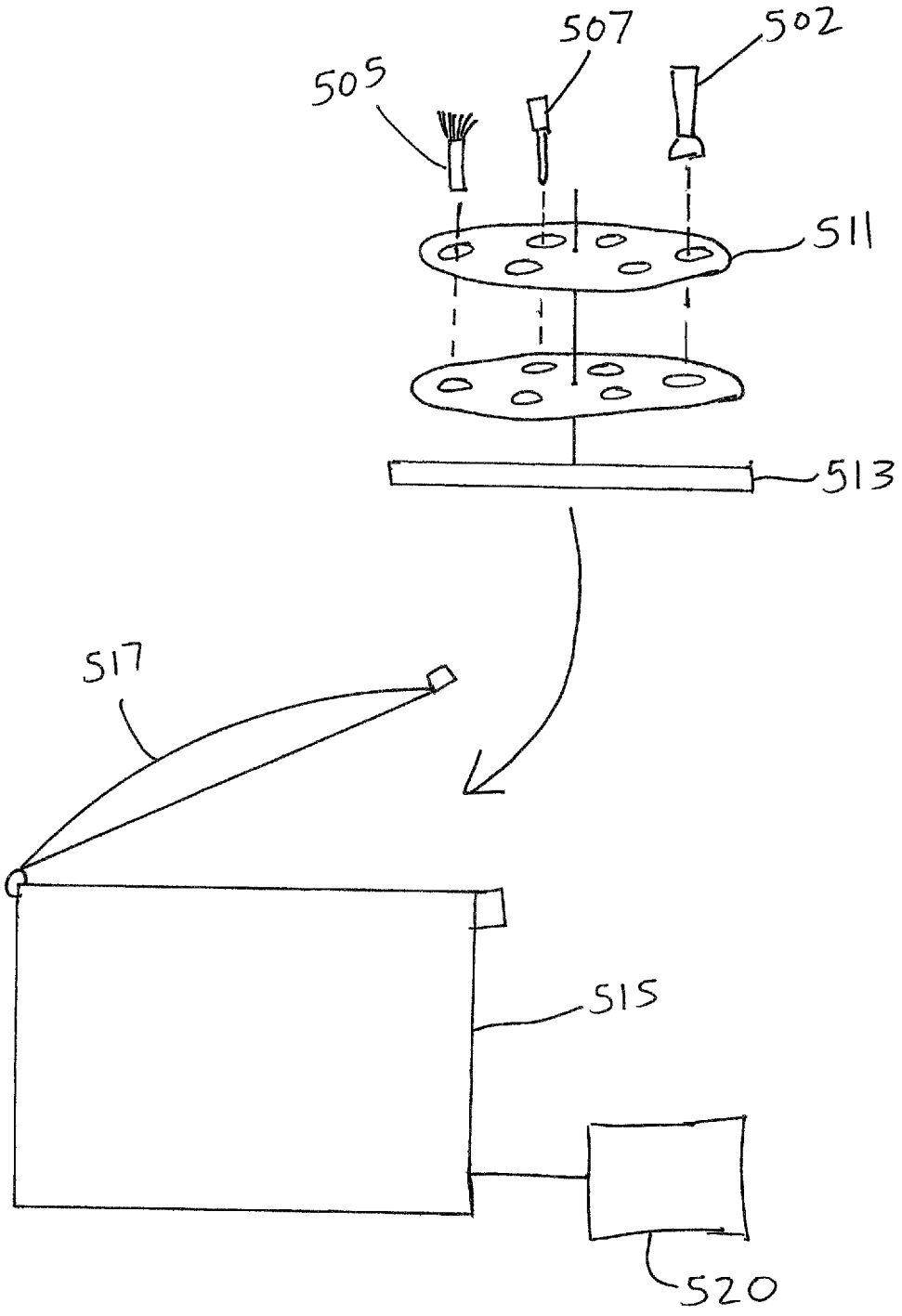
FIG. 2 is a schematic illustration of an example material transport device in an open configuration.

FIG. 2 is a schematic illustration of an example material transport device in an open configuration. The lid 517 of the pressure vessel 515 is removable and/or openable. The lid 517 can be opened manually, and/or can be controlled by a controller 520 or other computer components in order to provide specific heat ramp up and ramp down times specific to the programmable media transport goals. The pressure vessel 515 contains the substrate providing the material to be transported and the substrate receiving the materials from the transport media. In some embodiments, a substrate holder 511 within the pressure vessel 515 holds the substrates donating the materials to be transported to the receiving substrate. A holding tray 513 may be provided to hold the receiving substrate. In an example configuration, the substrate holder 511 includes holes, which may or may not vary in size and may or may not be circular or elongated or rectangular or any combination of geometries to accommodate specific brushes or tools therein. In one example, cosmetic brushes 505 of various lengths, sizes, and/or materials can be held upright in the substrate holder 511. Hand tools such as screw drivers 507, metal brushes 502, or other items can serve as donating substrates. In some embodiments, the pressure vessel 515 and/or the substrate holder 511 may be designed such that the substrates can be placed ins spaced arrangement (e.g., a circular or rectangular pattern) to allow the transport media within the pressure vessel 515 to flow rapidly to all surfaces of the substrates and dissipate rapidly as material is transported away from the substrates.

Figure 3A:
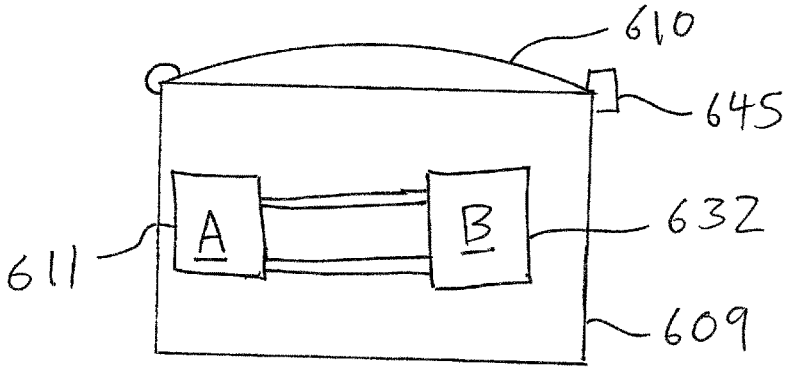
FIGS. 3A and 3B schematically illustrate the transport of materials between substrates within a material transport device.
Figure 3B:
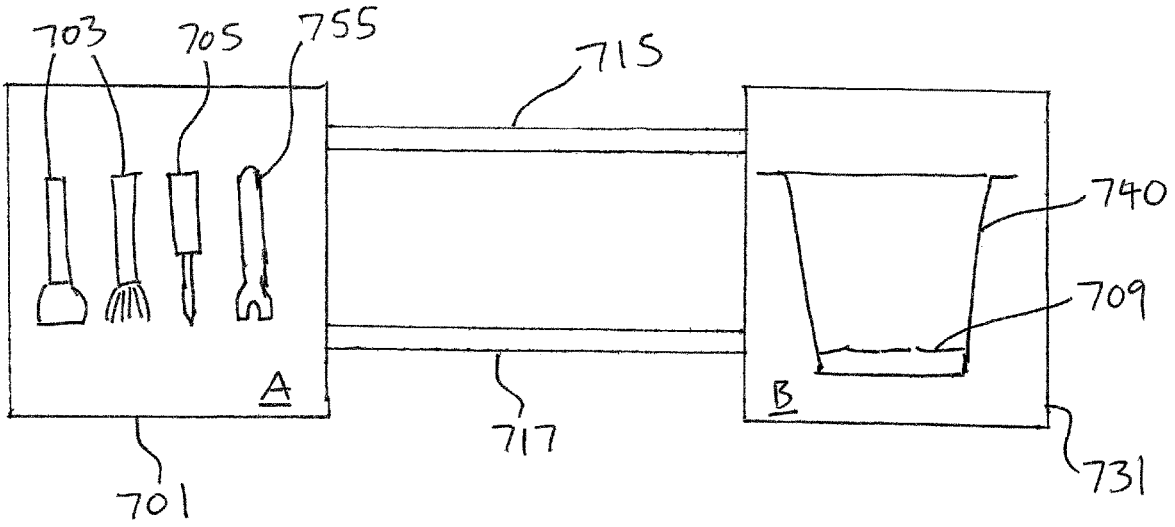

FIGS. 3A and 3B schematically illustrate the transport of materials between substrates within a material transport device. When the pressure vessel lid 610 is closed and sealed (e.g., secured by the latch 645), a transport medium inside of the pressure vessel 609 can be contained and controlled. For example, the phase of the transport medium may be controlled by maintaining and/or modifying the temperature and pressure within the pressure vessel 609, such that the transport medium can be used to transport materials from the donating substrate A 611 to the receiving substrate B 632. In one example, the donating substrates can be a set of tools on a rack 701. Tools such as brushes 703, screwdrivers 705, or other hand tools 755, may be placed on the rack 701 for material transport therefrom without requiring any contact or rigid mounting. A transport medium within the pressure vessel 609 can then be modulated in phase to optimize the transport of materials 709. A flow can be induced in the transport medium, such as by pumping the medium between chambers or substrate locations A 701 and B 731 through transport tubes 715 and 717. Thus, materials 709 initially on the surface of substrate A can be carried away from substrate A and delivered to substrate B 740. In an example embodiment, substrate B 740 is in the shape of a basket for easy removal from the area B 731.

Figure 4B:
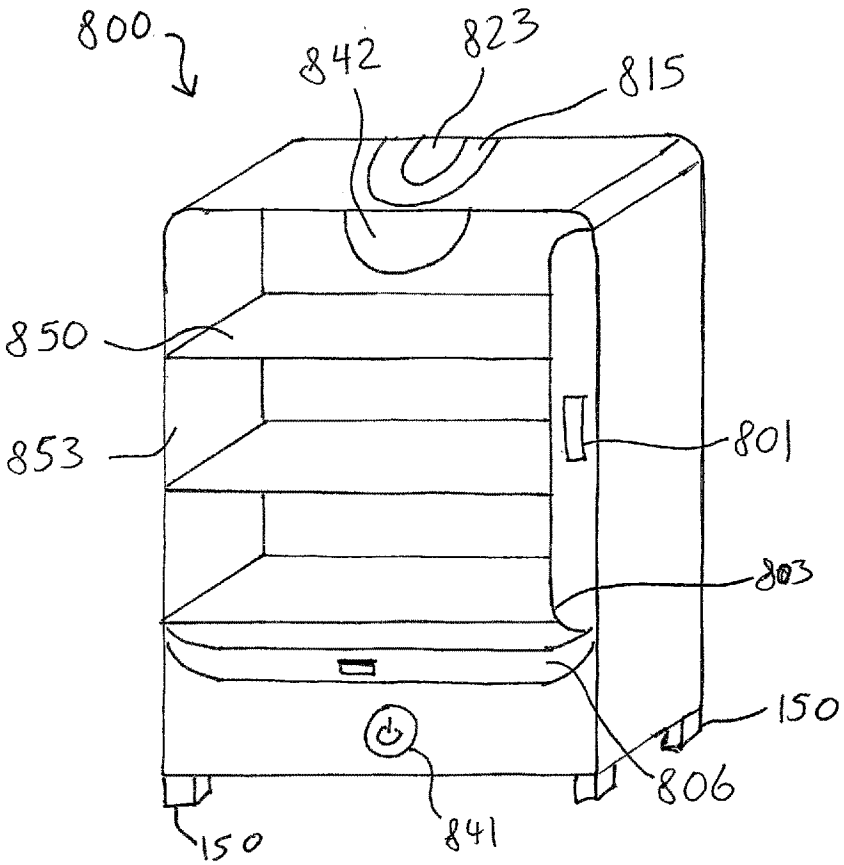
FIGS. 4A and 4B depict a stationary material transport device in accordance with an example embodiment.
Figure 4A:
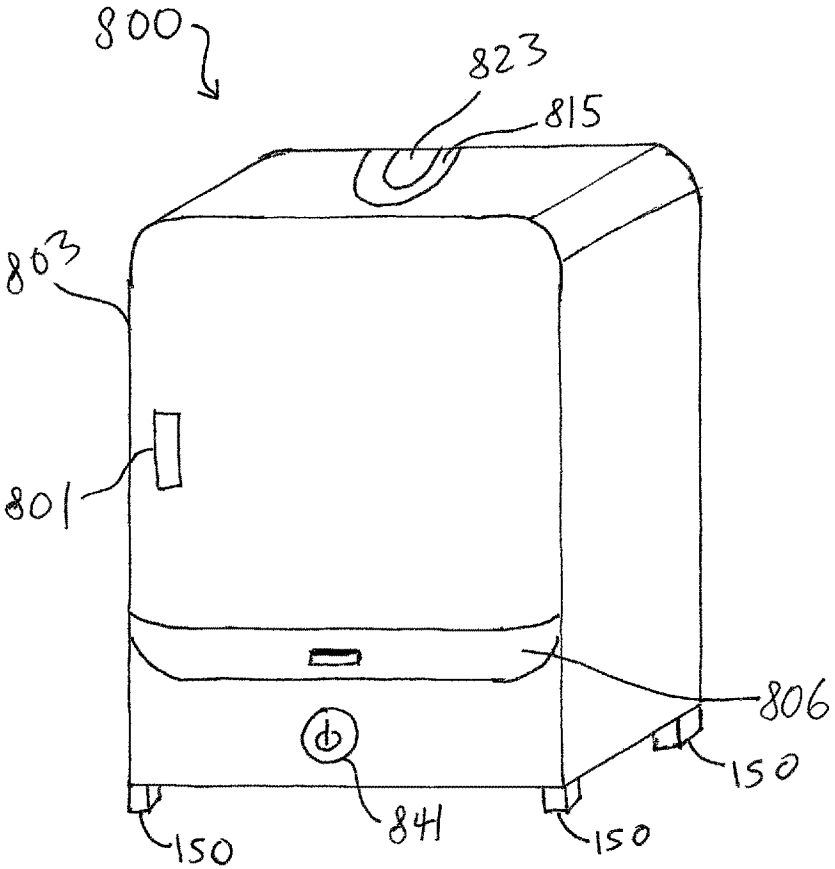

FIGS. 4A and 4B depict a stationary material transport device 800 in accordance with an example embodiment. The material transport device 800 is configured, for example, for tabletop or countertop operation. In some embodiments, the material transport device 800 can be scaled to accommodate multiple substrates. For example, an array of synthetic and natural brush materials used in the application of cosmetics may be accommodated within the material transport device 800. The relatively large capacity of the material transport device 800 allows for full household power to be used and an expanded array of phases and compositions to be utilized as the transport media. In some embodiments, the material transport device 800 can be scaled to a relatively large size for commercial use. For example, the material transport device 800 may have a size and transport cycle duration configured to accommodate cleaning of up to 20, 50, 100, or more items (e.g., makeup brushes) in a relatively short duration such as 10 minutes, 20 minutes, 30 minutes, etc. In some embodiments, the material transport device 800 may be relatively compact for convenience. For example, some embodiments of the material transport device 800 may have length, width, and height dimensions less than 18 inches, less than 24 inches, less than 30 inches, etc., and may weigh less than 40 pounds, less than 50 pounds, less than 60 pounds, etc. The components of the material transport device 800 can be contained within the device and controllable using a button or other simple controls such that an unskilled user may operate the material transport device 800. The interior shown in FIG. 4B demonstrates a racked arrangement possible to service the material transport away from multiple objects such as small brushes and/or other utensils. This arrangement may also facilitate UV irradiation for additional sterilization for utensils used in some human or animal applications.

The material transport device 800 includes a door 803 operable by a handle 801. In some embodiments, the door 803 can be partially or entirely composed of a transparent or translucent material. The door 803 may further be hinged and/or slidable for pleasing aesthetics, such as in a luxury lavatory or salon setting. In some embodiments, the handle 801 can be lockable by a cam lock or other locking system (not shown) to secure the pressure vessel. The trays 850 in the interior 853 of the material transport device 800 may be moveable within the interior 853 and/or may be removable for maintenance, cleaning, and/or accommodation of large or irregularly shaped substrates. The material transport device 800 can further include legs 150 which may provide thermal insulation between the material transport device 800 and the surface below, such as a desktop, tabletop, counter, or the like.

One or more cartridges containing a transport medium can be loaded at the top of the device. In the example embodiment depicted, the cartridge is loaded by lifting a handle or pullup lever 815 that opens and/or locks the cartridge chamber lid 823. When the lever is opened, a cartridge may be placed into a transport media housing 842, which may include a nozzle or other structure for securably receiving the cartridge. Once lever 815 is closed again, the cartridge can be punctured and the transport medium released to start the process of moving materials from substrates within the material transport device 800. In some embodiments, the transport medium within the cartridge can be pure $CO_2$, or can be $CO_2$ mixed with a relatively smaller amount of a co-solvent such as alcohol, and/or one or more additional agents for flavoring, scenting, strengthening, condition, or otherwise treating the substrates within the material transport device 800.

The transport material (e.g., effluent) can be deposited in a pullout tray 806 located at the bottom of the material transport device. The pullout tray 806 may have sufficient capacity to collect effluent from several cycles of material transport events. For example, the pullout tray 806 may be large enough that it need only be emptied after 2, 5, 10, or more material transport cycles. The pullout tray 806 may be reusable or may be disposable. A button 841 may be provided to allow a user of the material transport device 800 to initiate a material transport cycle. In some embodiments, computer control of the transport cycle may be automatic and may be configured to ensure proper transport of cosmetic materials from synthetic and natural brush substrates located within the material transport device 800, such that the material is deposited in the tray 806 for easy disposal. In some aspects, the button 841 may be configured to color to indicate various stages of the material transport process.

Moreover, the material transport device 800 may further include light sterilization functionality, such as by ultraviolet germicidal irradiation or ultraviolet sterilization. For example, the material transport device 800 may include one or more UV light sources (not shown) configured to expose substrates located on the trays 850 to UV radiation for a desired amount of time. In some aspects, the UV light sources may be located at the top of the material transport device 800, and/or may be disposed along vertical surfaces of the interior 853 to provide even irradiation when a plurality of items are in the material transport device 800. UV radiation may be provided by one or more UV LEDs or other UV emitters. UV sterilization can be performed as a standalone cycle or as an enhancement to a material transport cycle, and may be implemented before, during, and/or after the material transport cycle. In various embodiments, the wavelengths provided by the UV light sources may be within the range of 100 nm and 400 nm, or a sub-range such as between 200 nm and 300 nm, between 240 nm and 280 nm, or other suitable wavelengths.

Figure 4D:
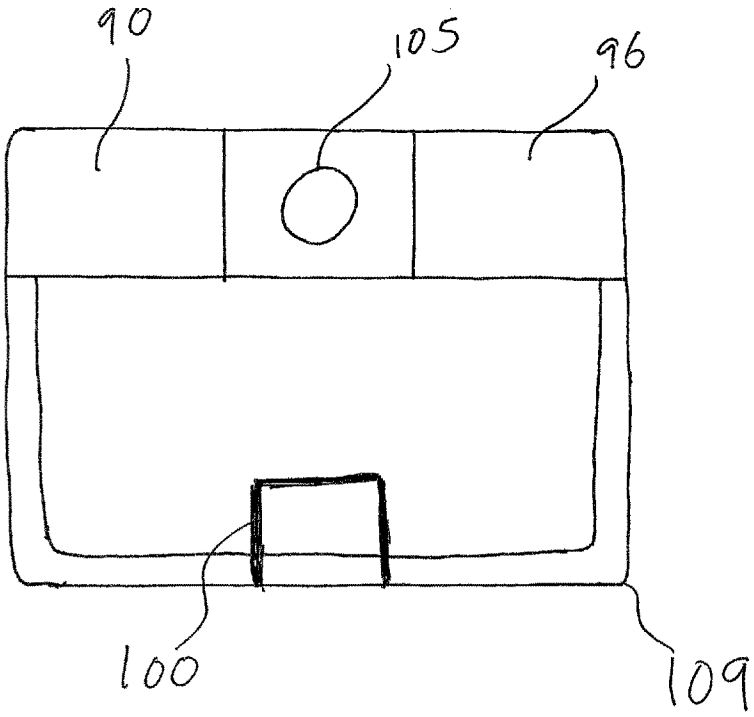
FIG. 4D depicts an example material transport device including a transparent or partially transparent exterior surface.
Figure 4C:
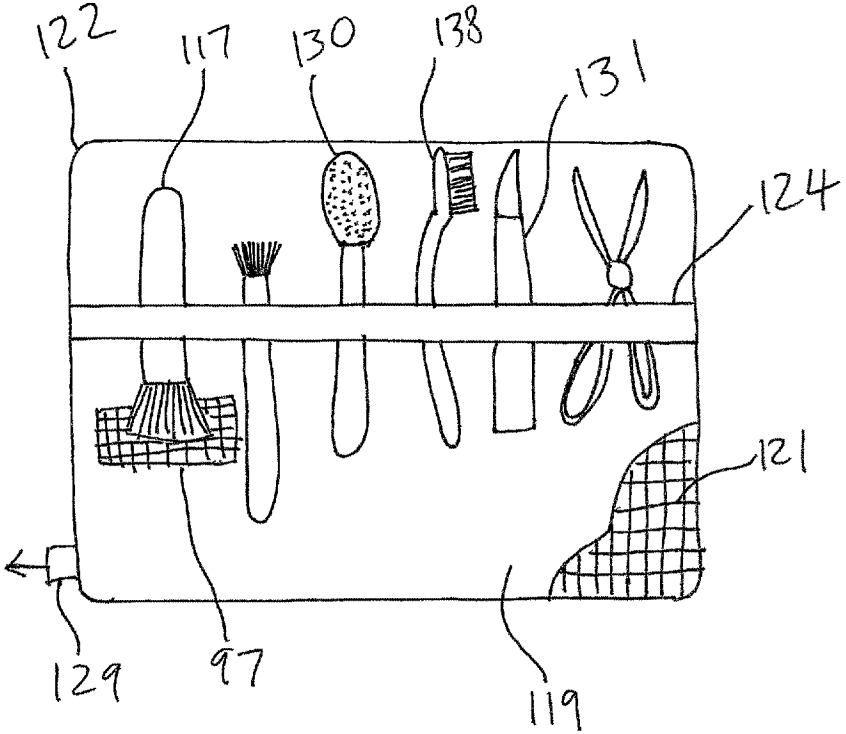
FIG. 4C depicts an example interior configuration of a material transport device.

FIG. 4C depicts an example interior configuration of a material transport device. In some embodiments, the interior configuration of FIG. 4C may be implemented with the trays 850 in the material transport device 800, or may be implemented in other material transport device configurations. The interior configuration of FIG. 4C includes a surface 122, which may be transparent or semi-transparent. An elastomeric brush holding strap 124 coupled to the surface 122 is suitable for adapting to different types utensils, such as surgical tools 131, make up brushes 117, oval side applicator type brushes 130 and 138, or other items. The surface 122 may be a horizontal surface for supporting the utensils. The surface 122 can be partially or entirely composed of a solid nonporous material 119 or a screen material 121. In some embodiments, the surface can include a solid nonporous material 119 with screened sections 97. An exhaust port 129 can allow for the evacuation of solid effluents.

FIG. 4D depicts an example material transport device including a transparent or partially transparent exterior surface 109. In some embodiments, the transparent or partially transparent exterior surface 109 may be implemented with the material transport device 800, or may be implement in other material transport device configurations. The fully or partially transparent exterior surface 109 can allow a user to see the locations of a carbon dioxide cartridge chamber 105, a fluid reservoir 96, and a heating and pressurization chamber 90. The fluid reservoir 96 can be configured to hold one or more of a detergent, co-solvent, fragrance, flavor, and/or a cleaning agent. Solvents can include alcohols, water, volatile organic hydrocarbons, or the like. A plumbing system can be configured to combine carbon dioxide from the carbon dioxide cartridge chamber 105 with fluids from the fluid reservoir 96, and deliver the combined fluids to the heating and pressurization chamber 90. At the heating and pressurization chamber 90, the combined fluids can be phase modulated or otherwise conditioned for subsequent delivery via jetted systems to a cleaning chamber. The temperature and pressure of the cleaning cycle is controlled and monitored through a controller 100.

Figure 5A:
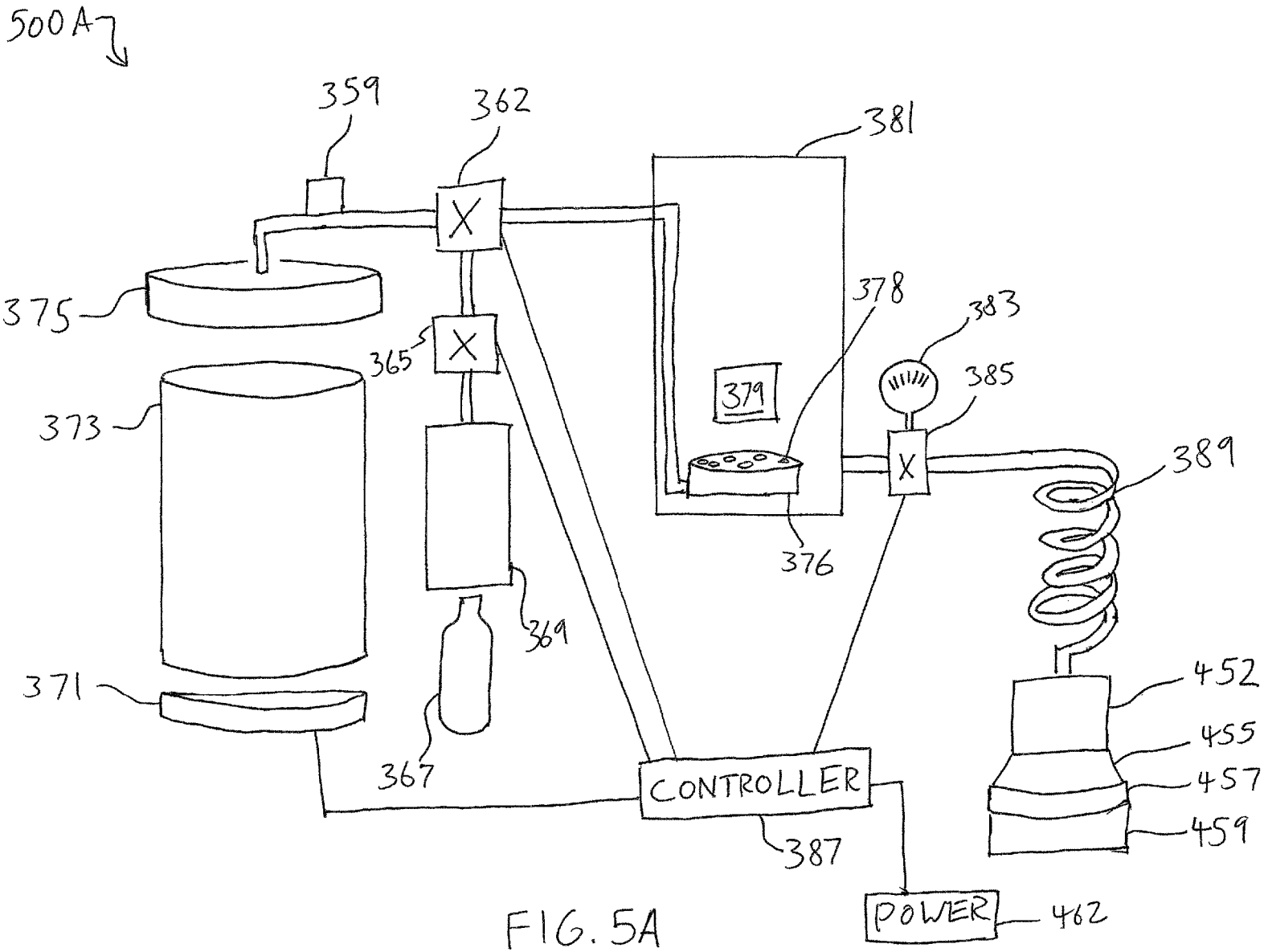
FIGS. 5A and 5B schematically illustrate components of example material transport device configurations.
Figure 5B:
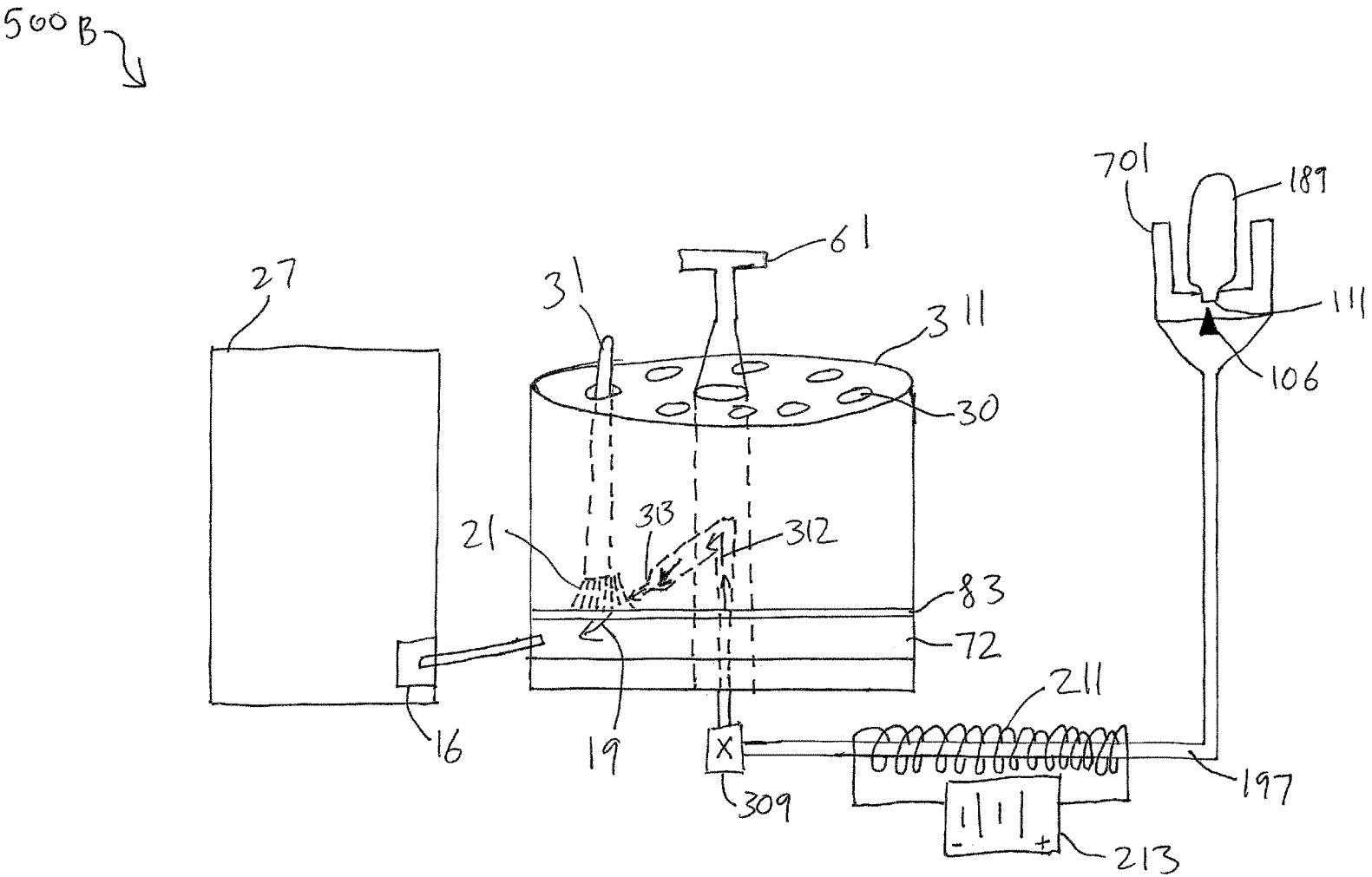

FIGS. 5A and 5B schematically illustrate components of example material transport device configurations. In the embodiment depicted in FIG. 5A, a material transport device 500A is configured to transport materials from a first substrate located in a chamber 381 to a second substrate such as a filter 457. A pressure vessel 373 is accessible by a user to insert solid or liquid materials as a transport medium composition. In some embodiments, the transport medium may be a homogeneous material or a mixture of materials to secure an appropriate transport medium for the target substrates and materials to be transported between them. For example, the transport medium deposited in the pressure vessel 373 can be solid carbon dioxide or dry ice. A heating element 371 is provided to head the pressure vessel 373. In some embodiments, the heating element 371 can be controlled by a controller 387. The controller 387 can include a human control and parameter input interface for inputting variables into the process control computer that control the outcome of the process on the transport of media between two substrates. The pressure vessel 373 is accessed through a lid 375. A blowoff valve 359 or other pressure release system can be activated if pressures within the pressure vessel 373 exceed a predetermined safe threshold. A valve and regulator 362 is in fluid communication with the pressure vessel 373, and is configured to ensure proper modulation of the phase of the transport media. In various embodiments, the valve and regulator 362 can include a single valve and regulator device, or can include a separate valve and regulator. The pressure within the pressure vessel 373 in some embodiments may be controlled by mechanical compression of the pressure vessel 373 and/or by addition of inert gases at high pressure (e.g., helium, argon, etc.). In various embodiments, the pressure vessel 373 may be configured to withstand pressure ranges such as between 0 and 15,000 psi, or a sub-range, such as between 0 and 11,000 psi, between 0 and 5,000 psi, between 0 and 1,100 psi, or other pressure range.

In some embodiments, the material transport device 500A includes a cartridge system 369 in addition to or instead of the pressure vessel 373 as the source of material transport media. In some embodiments, receiving material transport media from a sealed cartridge 367 may enhance safety and ease of use. A cartridge system valve 365 controls the flow from the cartridge system 369 to the valve and regulator 362 when both a cartridge system 369 and pressure vessel 373 are provided. The cartridge 367 can be sealed with a puncture type seal at the top. When the cartridge 367 inserted into the cartridge system 369, the seal is punctured and the transport medium within the cartridge 376 can be delivered under pressure to the system through the valve and regulator 362 into the dispensing chamber 376. In some embodiments, the dispensing chamber 376 has plumbing and apertures to deliver the phase and composition controlled transport medium into the chamber at the relative location where it can be most effective at cleaning a substrate 379 mounted within the chamber 381. For example, the substrate 379 can include brushes, smoking devices, or the like, held into position using rigid or elastomeric securing means. The chamber 381 can be accessible by the user for ease of access in loading and unloading substrates for cleaning. In some embodiments, the dispensing chamber 376 is in fluid communication with an array of jets 378 surrounding the substrate 379.

An effluent from the chamber may comprise a combination of transport media in a phase and composition modulated state, as well as material transported from the substrate 379. The effluent exits the chamber 381 at a regulated pressure by way of a pressure and flow regulator 385. A gauge 383 monitors and reports to the controller 387, and may further read out on a display the progress of the reaction and transport of media. The effluent may continue to a condenser coil system 389. The condenser coil system 389 may allow the transport media and transported material within the effluent to at least partially return to an ambient temperature and/or pressure. The condenser coil system 389 further delivers the effluent into a diffusion tank 452, where it can be equilibrated with the atmosphere. The effluent is expelled through a filter holder 455 into a filter 457 and/or a tray 459 or other second substrate. The tray 459 and/or filter 457 can be removed easily for disposal of the collected media that was transported from the first substrate 379 in the chamber 381. In some embodiments, a heating element (not shown) may allow the transported material to be pyrolyzed and/or deposited on the tray by evaporative deposition. In one example, the filter 457 is a screen filter (e.g., a metal screen filter) capable of withstanding high temperatures, such that the material deposited on the screen can subsequently be pyrolyzed by a heat source such as a flame or torch. In some aspects, the heat source can be a coil or other heating element within the device 500A, or may be an externally applied heat source.

In another embodiment, depicted in FIG. 5B, a material transport device 500B is configured to utilize transport medium from a cartridge to clean materials in a vessel that may or may not be closed or sealed. A brush holder 311 or other holder for substrates to be cleaned can be open or closed. In the material transport device 500B, the brush holder 311 includes retainer holes 30 configured to support a plurality of items in an upright position within the brush holder 311. A handle 61 is positioned to connect to the brush holder 311 in order to easily load brushes 31 or other substrates into the retainer holes 30. Although the material transport device 500B is described with reference to cleaning brushes, it will be appreciated that the material transport device 500B can equally be used to clean other substrates, such as smoking devices or the like.

A pressurized and foil sealed cartridge 189 is pressed onto a seal puncture system 106 and contained within a holder 701. After the foil seal 111 is punctured, the cartridge 189 delivers a transport medium under pressure to a pressure chamber 197, which may include a plumbing feature such as a tube or pipe, or the like. In the pressure chamber 197, the contents are heated to a predetermined temperature or range of temperatures via a heating coil 211 or heated jacket by current source 213. The current source 213 can be controlled by a microcontroller or other computer-programmable integrated circuit device. The contents of the pressure chamber 197 are contained under pressure by a pressure release valve 309 until a predetermined threshold release pressure is achieved. In some embodiments, the temperature range and release pressure can be determined so as to ensure that a known transport medium within the pressure chamber 197 will be in a supercritical or near supercritical phase. In some aspects, the pressure release valve 309 can be a check valve, such as a spring mechanical check valve, configured to open upon reaching a threshold pressure and to prevent backflow into the pressure chamber 197.

Once the release pressure is achieved, the transport medium 312 in a supercritical or near supercritical phase is sent through jets nozzles 313 into the brush material 21 or other portion of a brush 31 or other substrate to be cleaned. The brush material 21 is fully engulfed in the supercritical or near supercritical transport medium 19 due to the flow from the jet nozzles 313. As the supercritical or near supercritical transport medium 19 flows around the brush material 21, particles of material, such as various contaminants to be removed, are carried by the stream of the transport medium 19 to form an effluent containing the transport medium and the particles of transported material. A screen 83 isolates a collection chamber 72 from the brush 31 and other substrates. The effluent can then be removed to a vacuum chamber 27, which can create a partial vacuum or negative pressure through port 16 in fluid communication with the collection chamber 72. The port 16 can be an outlet port. In some embodiments, the port 16 is located in the lower 50% of the device such that the collection of particles and transport medium can be assisted by gravity. The screen 83 can support the brush 31 while allowing the effluent to pass through to the collection chamber 72 and the vacuum chamber 27. In some embodiments, the transport medium may cool to a non-supercritical state, such as a gas phase, and may leave the device 500B through holes 30, while the transported materials may pass downward through the screen 83.

Figure 6B:
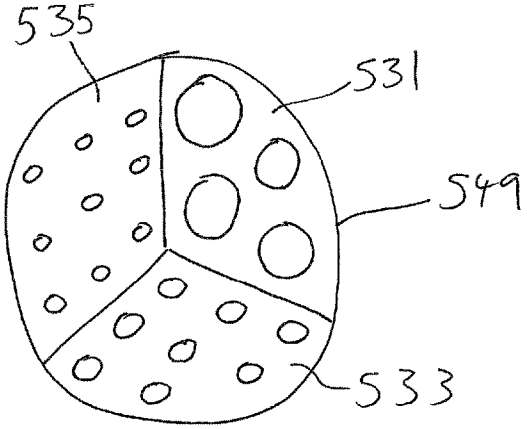
FIGS. 6A-6C depict interior components for holding a substrate within a material transport device.
Figure 6C:
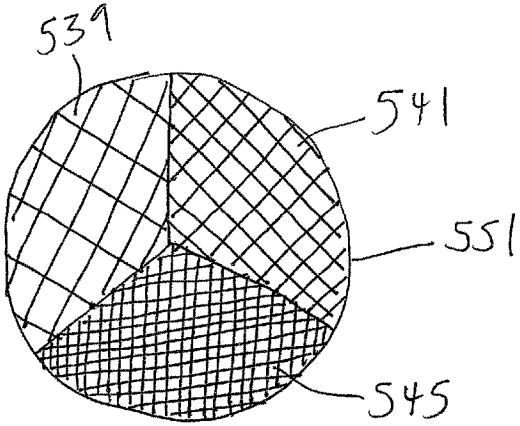
Figure 6A:
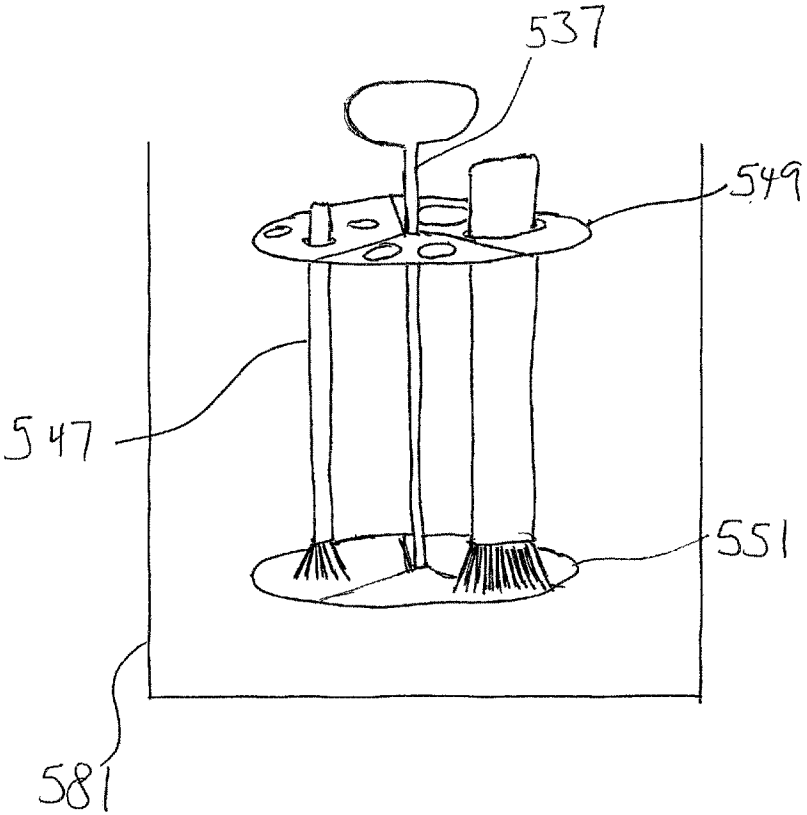

FIGS. 6A-6C depict interior components for holding a substrate within a material transport device. For example, the components depicted in FIGS. 6A-6C may be implemented in material transport devices 500A and 500B depicted in FIGS. 5A and 5B. In various embodiments, a holder 537 is configured to support one or more substrates 547 to be processed within a chamber 581. An upper support 549 can holes of various sizes, including large holes 531, medium holes, 533 and small holes 535, such that many sizes of substrate materials can be organized and placed within the chamber 581. In some embodiments, such as a makeup or cosmetic brush infuser and sterilizer and/or a material transport device 500B as depicted in FIG. 5B, the system also incorporates a screened lower support 539 that varies with the kind of substrate being mounted. For example, a thicker screen 539, medium density screen 541, and/or a fine screen 545 can aid in the material transport process, such as by supporting the substrates 547 while allowing effluent to pass through toward the bottom of the chamber 581.

Figure 7:
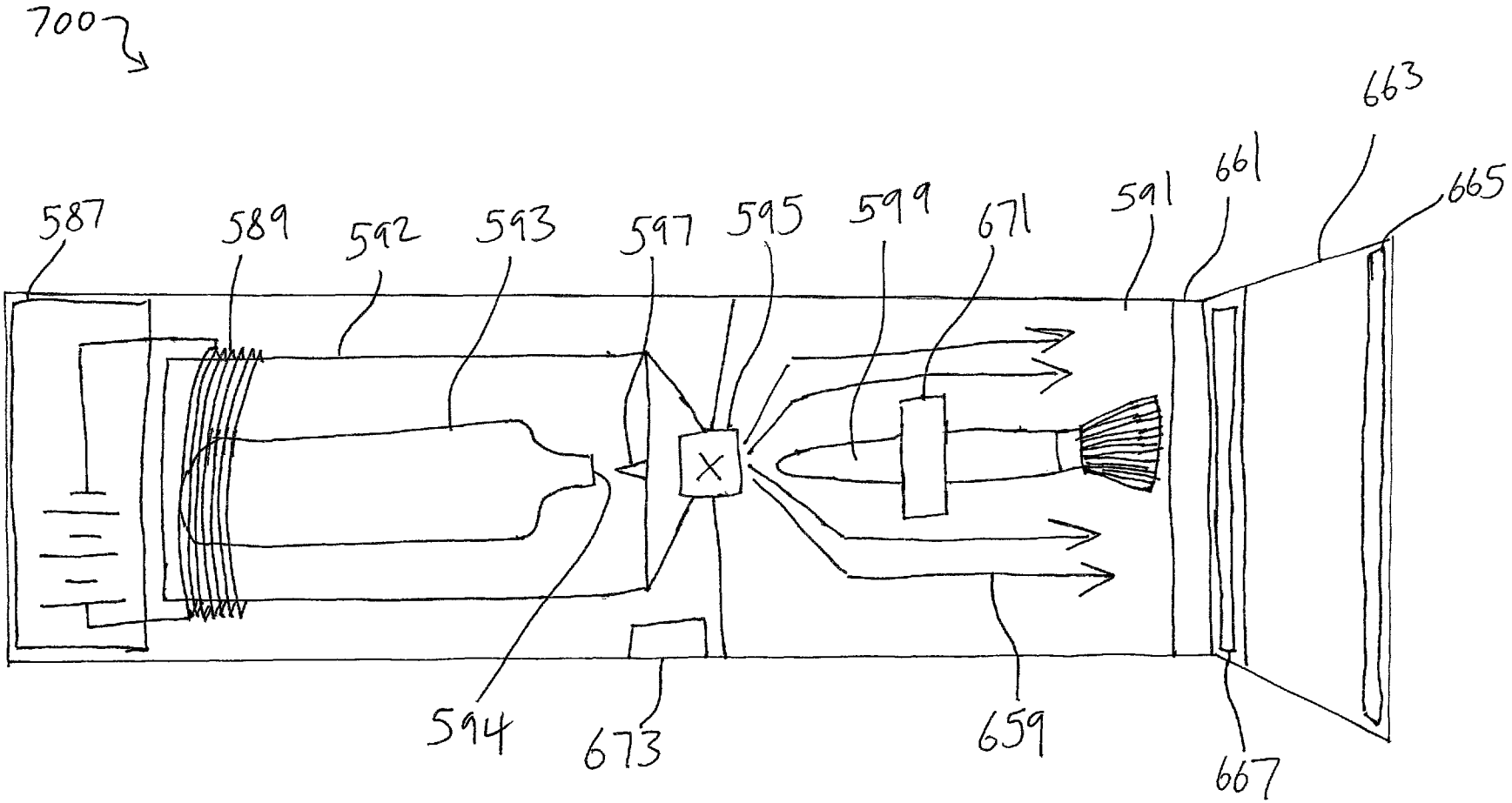
FIG. 7 schematically illustrates an example material transport device configured to be compact and/or portable.

FIG. 7 schematically illustrates an example material transport device 700 configured to be compact and/or portable. In some embodiments, the portable material transport device 700 can be transported easily in a carry bag or by hand. For example, the material transport device 700 may be substantially cylindrical in shape with a diameter of 3 inches, 4 inches, 5 inches, etc., and not longer than 12 inches, 18 inches, 24 inches, etc. The portable material transport device 700 may be lightweight, e.g., may weigh less than 15 pounds, less than 10 pounds, less than 5 pounds, etc. The material transport device 700 is generally configured to transport materials from a substrate 599 located within a chamber 591 of the device 700. For example, the material transport device 700 may be configured such that a cosmetic brush, dry cannabis plant materials, or other substrates can be conveniently loaded into the chamber 591. The material transport device 700 may require relatively low power, such that it may be powered by a commercially available battery away from a utility power supply. In some embodiments, the material transport device 700 may be configured to operate without any electrical power, such as with a mechanical trigger configured to release a material transport medium, as will be described below.

The material transport device 700 may be battery powered, for example, by a battery 587 located at a first end of the device 700. The battery 587 can be any type of commercially available electrochemical cell. The battery 587 can be disposed adjacent to a cartridge container 592 surrounding a cartridge 593 containing a transport medium. The battery 587 powers a heater 589 adjacent to or surrounding the cartridge 593, such that the heater can drive phase states that are above room temperature. In an example implementation, a user may insert a cartridge 593 into the cartridge container 592. An activator puncture pin 597 punctures a seal 594 of the cartridge 593. Thus, the cartridge 593 delivers the transport medium contained therein to a valve regulator system 595. In some embodiments, the valve regulator system 595 may be controlled by a mechanical trigger 673. The device can be controlled by a controller or other computer or processing circuitry. In various embodiments, the trigger 673 can directly control the valve regulator system 595, and/or may initiate an automated process in which the valve regulator system 595 is controlled by the controller or other circuitry. In non-powered embodiments, the mechanical trigger 673 may directly cause the transport medium to flow from the pressurized cartridge 593 into the chamber 591.

The chamber 591 can be configured to hold various single or multiple substrates 599 so as to receive the modulated transport media from the cartridge 593 by way of guided jets 659 emitted from the valve regulator system 595. The substrate 599 can be held in an optimal position by a substrate retainer 671, such as a collar, mesh container, or the like, in the chamber 591. The substrate retainer 671 can be selected based on the type of substrate to be treated. In some embodiments, multiple interchangeable or simultaneously usable substrate retainers 671 may be provided for use with the material transport device 700. For example, the substrate retainer 671 may include a collar or elastomeric strap for retaining a brush, pipe, water pipe or hookah component, or the like. The substrate retainer 671 may further include a mesh enclosure or other permeable container for retaining organic material such as tobacco, cannabis, or plant matter containing essential oils or other extractable substances.

After passing the substrate 599 and collecting material therefrom, the transport medium and transported material is expelled as effluent at ambient pressure through a diffuser 661. The material that was transported from the substrate 599 is deposited on a filter 667 and/or in a second substrate 665. The transport medium then exits the material transport device 700 to the atmosphere through a diffusion bell 663. In some embodiments, depositing the transported material on a second substrate 665 may be desirable for solid disposal in an appropriate waste container without consumable products. In extraction-related implementations, the second substrate 665 may include a storage vessel for storage of essential oils, cannabis or tobacco extracts, or the like extracted from the substrate 599 by the transport medium.

Figure 8B:
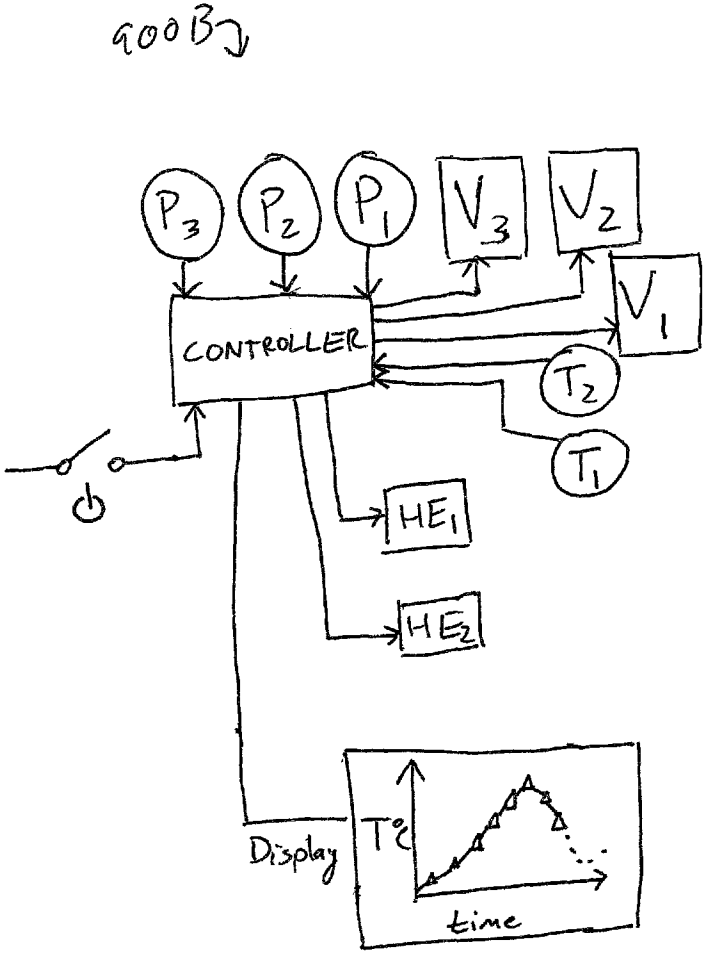
FIGS. 8A and 8B schematically illustrate an example system for controlling temperature, pressure, and fluid flow in a material transport device.
Figure 8A:
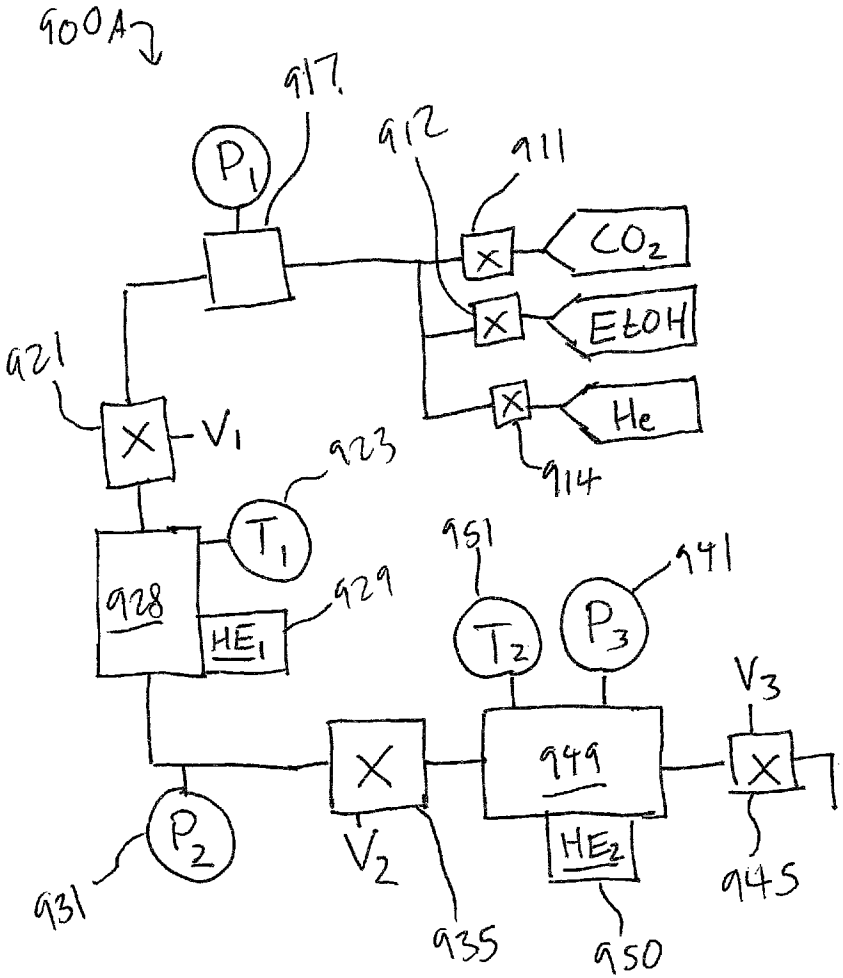

FIGS. 8A and 8B schematically illustrate an example system for controlling temperature, pressure, and fluid flow in a material transport device. FIG. 8A schematically depicts a material transport device 900A. FIG. 8B schematically depicts an automated control system 900B for controlling the temper, pressure, and fluid flow within the material transport device 900A.

The material transport device 900A includes a pressure chamber 928 for conditioning of transport media, and an extraction chamber 949 configured to retain a substrate for material transport as described elsewhere herein. The pressure chamber 928 is associated with a temperature sensor $T_1$ 923 and a heating element $HE_1$ 929 for monitoring and control of the temperature within the pressure chamber 928, and a pressure sensor $P_2$. Similarly, the extraction chamber 949 is associated with a temperature sensor $T_2$ 951, a heating element $HE_2$, and a pressure sensor $P_3$ 941. The material transport medium comprises a mixture of one or more of $CO_2$, ethanol, and helium. Valve 911 controls the flow of $CO_2$ into the mixture, valve 912 controls the flow of ethanol into the mixture, and valve 914 controls the flow of helium into the mixture. A pressure sensor $P_1$ 917 monitors the pressure of the transport medium outside of the pressure chamber 928. Valve $V_1$ 921 controls the flow of the transport medium into the pressure chamber 928. Valve $V_2$ 935 controls the flow of the transport medium from the pressure chamber 928 into the extraction chamber 949. Valve $V_3$ 945 controls the flow of effluent, including the transport medium and particles of transported material out of the extraction chamber 949 (e.g., into the atmosphere, to a receiving substrate, etc.).

As shown in FIG. 8B, the control system 900B includes a controller configured to receive as inputs the pressure readings from pressure sensors $P_1$, $P_2$, and $P_3$, and the temperature readings from temperature sensors $T_1$ and $T_2$. The controller is further configured to receive an activation signal from a power switch, which may be a button on an exterior surface of the material transport device 900A, for example. The controller is configured to send control signals to valves $V_1$, $V_2$, and $V_3$ (e.g., to open or close valves), and to send control signals to heating elements $HE_1$ and $HE_2$ (e.g., to begin heating or stop heating). The controller is further configured to cause a display to show information indicative of the initiation, status, completion, or performance of a material transport sequence. For example, the controller can cause the display to show a graph of temperature and/or pressure of the transport medium over the duration of the material transport sequence.

The controller can be configured to evaluate one or more equations and/or use one or more lookup tables contained in a computer memory in communication with the controller, to determine a phase of the transport medium in the pressure chamber 928 or the extraction chamber 949 of the material transport device 900A. The computer memory may further include one or more sets of computer-executable instructions that cause the controller to perform a series of heating and valve control steps to carry out a material transport sequence.

With reference to FIGS. 8A and 8B, a material transport sequence will now be described by way of example and not by way of limitation. It will be appreciated that any of the steps described below may be modified, reordered, omitted, duplicated, or the like, without departing from the scope of the present disclosure. In an example material transport sequence, an initial state may have all three valves $V_1$, $V_2$, $V_3$ closed, and both heating elements $HE_1$ and $HE_2$ off. The power switch may be activated to initiate the material transport sequence. Upon activation of the power switch, the controller can initiate the sequence by opening valve $V_1$ to allow the gas mixture to flow into the pressure chamber 928. When the pressure $P_2$ reaches a predetermined threshold, the controller closes valve $V_1$ and activates heating element $HE_1$ to heat the pressure chamber 928 until the temperature $T_1$ and pressure $P_2$ indicate a supercritical phase of the gas mixture. For example, if the transport medium is primarily $CO_2$, the pressure chamber 928 may be heated until the temperature is between 20° C. and 80° C., or a sub-range such as between 40° C. and 80° C., and the pressure is between 1,000 psi and 5,000 psi. When the mixture in the pressure chamber 928 is supercritical, the controller turns off the heating element $HE_1$ and opens valve $V_2$.

When valve $V_2$ is opened, the supercritical mixture flows into the extraction chamber 949 as a material transport medium. Temperature sensor $T_2$ and pressure sensor $P_3$ monitor the temperature within the extraction chamber 949 to determine if the material transport medium is still in a supercritical or near supercritical phase. If the temperature drops too low, the controller can activate heating element $HE_2$ to ensure that the material transport medium remains supercritical or near supercritical. The material transport medium can be contained within the extraction chamber 949, or may be vented to the atmosphere or a receiving substrate if the controller opens valve $V_3$. In some embodiments, a pre-soak or pre-treatment mode may be utilized. In a pre-soak or pre-treatment mode, a lower-pressure liquid or gas phase may be introduced to the extraction chamber 949 for enhanced cleaning or extraction. Following the pre-soak or pre-treatment mode, an ordinary material transport sequence may be carried out as described above. In further embodiments, the material transport sequence may be followed by a post-treatment operation, for example, including the use of compressed gases to blow dry the substrate in the extraction chamber to ensure that the substrate is dry before removal. In another example, the post-treatment operation can include the use of post-treatment agents or UV light to sterilize the substrate.

Figure 8C:
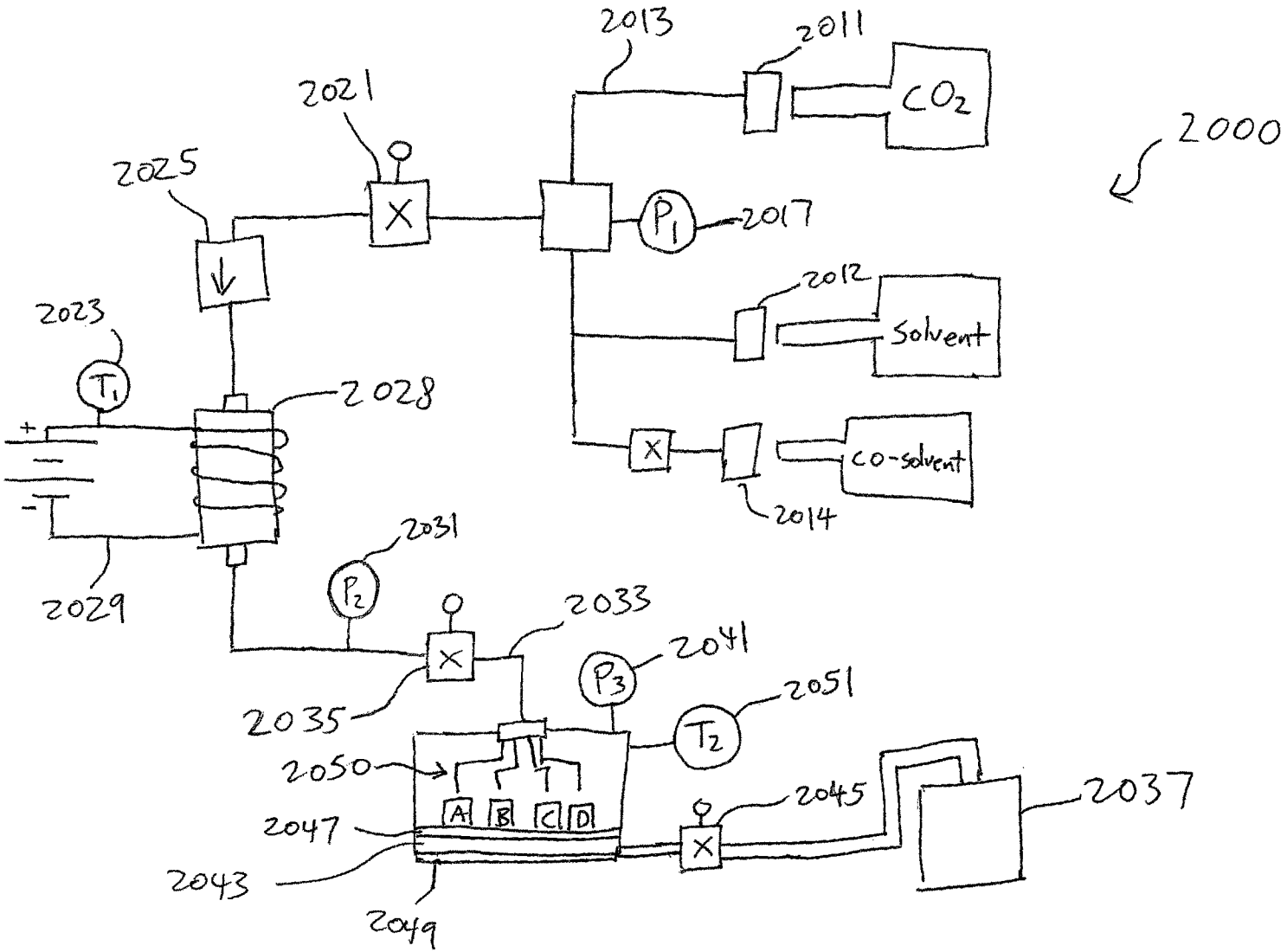
FIGS. 8C and 8D schematically illustrate additional embodiments of system for controlling temperature, pressure, and fluid flow in a material transport device.
Figure 8D:
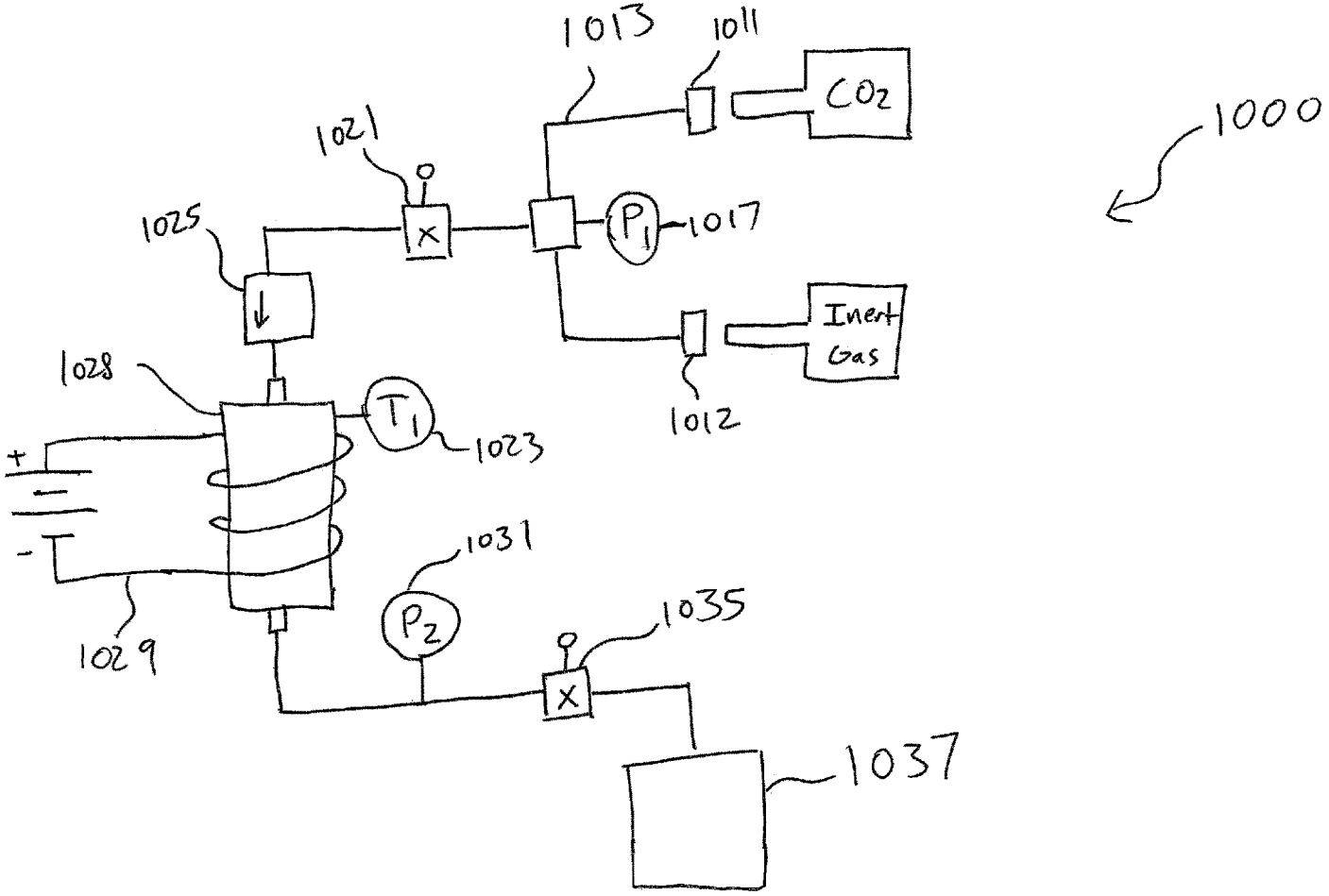

FIGS. 8C and 8D schematically illustrate additional embodiments of material transport devices 2000, 1000. Each of the material transport devices 2000, 1000 can be controlled by a temperature, pressure, and fluid flow control system similar to the control system 900B depicted in FIG. 8B. It will be appreciated that one or more controllers, microcontrollers, or the like, and one or more computer memory units can be implemented in conjunction with the devices 2000, 1000 schematically illustrated in FIGS. 8C and 8D, to carry out material transport sequences similar to the sequence described above with reference to FIGS. 8A and 8B.

Referring to FIG. 8C, the material transport device 2000 includes a pressure chamber 2028 for conditioning of transport media, and an extraction chamber 2049 configured to retain a substrate for material transport as described elsewhere herein. The pressure chamber 2028 is associated with a temperature sensor $T_1$ 2023 and a heating element 2029 for monitoring and control of the temperature within the pressure chamber 2028, and a pressure sensor $P_2$ 2031. Similarly, the extraction chamber 2049 is associated with a temperature sensor $T_2$ 2051 and a pressure sensor $P_3$ 2041. The extraction chamber 2049 includes a plurality of jet nozzles 2050 configured to direct a stream of supercritical or near supercritical material transport medium at each of a plurality of substrates A, B, C, D for efficient transport of material from the substrates A, B, C, D. The extraction chamber further includes a screen 2047 and a collection chamber 2043 as described above with reference to FIG. 5B.

The material transport medium comprises a mixture of one or more of $CO_2$, a solvent, and a co-solvent. Valve 2011 controls the flow of $CO_2$ into the mixture, valve 2012 controls the flow of the solvent into the mixture, and valve 2014 controls the flow of the co-solvent into the mixture. A pressure sensor $P_1$ 2017 monitors the pressure of the transport medium outside of the pressure chamber 2028. Valve 2021 controls the flow of the transport medium into the pressure chamber 2028, through a one-way valve 2025 to prevent backflow of material transfer media from the pressure chamber 2028. Valve 2035 controls the flow of the transport medium from the pressure chamber 2028 into the extraction chamber 2049. Valve 2045 controls the flow of effluent, including the transport medium and particles of transported material out of the extraction chamber 2049 to a receiving vessel 2037, such as a vacuum, storage container, or the like.

Referring now to FIG. 8D, the material transport device 1000 includes a pressure chamber 1028 for conditioning of transport media, and a chamber 1049 configured to retain a substrate for material transport as described elsewhere herein. The pressure chamber 1028 is associated with a temperature sensor $T_1$ 1023 and a heating element 1029 for monitoring and control of the temperature within the pressure chamber 1028, and a pressure sensor $P_2$ 1031. In the relatively simplified embodiment of FIG. 8D, the chamber 1049 is not associated with further temperature and pressure sensors. The chamber 1049 is configured to allow the material transport medium to collect material from the substrate contained therein, and vent to the atmosphere at ambient pressure, similar to the system described above with reference to FIG. 7.

The material transport medium comprises a mixture of one or more of $CO_2$ and an inert gas. Valve 1011 controls the flow of $CO_2$ into the mixture, and valve 1012 controls the flow of the inert gas into the mixture. A pressure sensor $P_1$ 1017 monitors the pressure of the transport medium outside of the pressure chamber 1028. Valve 1021 controls the flow of the transport medium into the pressure chamber 1028, through a one-way valve 1025 to prevent backflow of material transfer media from the pressure chamber 1028. Valve 1035 controls the flow of the transport medium from the pressure chamber 1028 into the chamber 1049.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used for the cleaning of contaminants from various utensils or other items and for the extraction of compounds from organic material, and are described herein with reference to these applications. However, it will be appreciated that the disclosure is not limited to this particular field of use.

Some embodiments have been described in connection with the accompanying drawings. The figures are not necessarily drawn to scale, and dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A cleaning apparatus comprising:

a cleaning vessel configured to receive a plurality of utensils, the cleaning vessel comprising:

a housing at least partially enclosing an interior space;

a utensil support structure at least partially within the interior space, the utensil support structure configured to support each of the plurality of utensils in a spaced configuration; and a plurality of nozzles, each nozzle of the plurality of nozzles configured to direct a fluid stream toward at least one utensil of the plurality of utensils;

a transport media delivery system in fluid communication with the cleaning vessel, the transport media delivery system comprising:

an input structure sized and shaped to sealingly receive a cartridge containing a transport medium;

a pressure vessel in fluid communication with the input structure, the pressure vessel configured to receive and contain at least a portion of the transport medium from the input structure;

a heating element configured to modulate the transport medium within the pressure vessel to a supercritical phase; and a fluid conduit configured to direct the transport medium from the pressure vessel to the plurality of nozzles of the cleaning vessel, such that each of the plurality of nozzles emits a stream of the supercritical transport medium toward the plurality of utensils, and wherein the stream of the supercritical transport medium causes contaminant particles to be dislodged from a surface of the utensils; and an effluent removal system comprising:

an outlet of the cleaning vessel configured to receive at least a portion of the transport medium and the dislodged contaminant particles; and a receiving substrate comprising at least one of a filter and a disposal tray, and configured to receive the dislodged contaminant particles.

2. The cleaning apparatus of claim 1, wherein the transport medium comprises carbon dioxide, and wherein the heating element is configured to heat the transport medium to a temperature greater than 20° C.

3. The cleaning apparatus of claim 1, wherein the cleaning vessel further comprises one or more ultraviolet (UV) light sources configured to irradiate the plurality of utensils with UV radiation.

4. The cleaning apparatus of claim 1, further comprising:

one or more valves configured to control the flow of the transport medium from the pressure vessel to the cleaning vessel; and a microcontroller in communication with the one or more valves and the heating element, the microcontroller comprising:

processing circuitry configured to open and close the one or more valves and activate the heating element; and a memory storing computer-executable instructions that, when executed by the processing circuitry, cause the processing circuitry to open and close the one or more valves and activate the heating element according to a predetermined cleaning cycle.

5. The cleaning apparatus of claim 1, wherein the utensil support structure comprises a brush support structure configured to hold a plurality of brushes or smoking utensils in a spaced configuration.

* * * * *